US005327597A

United States Patent [19]

Rothbard

[11] Patent Number: 5,327,597

[45] Date of Patent: Jul. 12, 1994

[54] CONVOLUTED MATTRESS PAD HAVING MULTIPLE PROXIMATE PEAKS

[76] Inventor: Michael Rothbard, 609 Interchange Dr., Atlanta, Ga. 30336

[21] Appl. No.: 908,312

[22] Filed: Jul. 2, 1992

[51] Int. Cl.[5] ..... A47C 27/00

[52] U.S. Cl. ..... 5/481; 5/901; 5/464

[58] Field of Search ..... 5/900.5, 901, 464, 468, 5/481

[56] References Cited

U.S. PATENT DOCUMENTS

| | | | |
|---|---|---|---|
| D. 308,453 | 6/1990 | Elrod . | |
| 3,016,317 | 1/1962 | Brunner | 5/481 |
| 3,681,797 | 8/1972 | Messner | 5/900.5 |
| 4,064,578 | 12/1977 | Yamada | 5/481 |
| 4,276,666 | 7/1981 | Yamada | 5/901 |
| 4,603,445 | 8/1986 | Spann . | |
| 4,620,337 | 11/1986 | Williams | 5/901 |
| 4,686,724 | 8/1987 | Bedford | 5/901 |
| 4,741,058 | 5/1988 | Williams et al. . | |
| 4,768,251 | 9/1988 | Baskent . | |
| 4,816,494 | 3/1989 | Watson, Jr. et al. . | |
| 4,825,488 | 5/1989 | Bedford . | |
| 4,862,538 | 9/1989 | Spann et al. . | |
| 4,868,800 | 9/1989 | Bedford . | |
| 4,879,776 | 11/1989 | Furley | 5/901 |
| 4,955,096 | 9/1990 | Gilroy | 5/900.5 |
| 4,999,868 | 3/1991 | Kraft | 5/481 |
| 5,007,124 | 4/1991 | Raburn et al. . | |
| 5,022,111 | 6/1991 | Fenner, Sr. . | |
| 5,025,519 | 6/1991 | Spann et al. . | |
| 5,031,261 | 7/1991 | Fenner, Sr. . | |
| 5,134,735 | 8/1992 | Rose | 5/901 |

FOREIGN PATENT DOCUMENTS 1128111 9/1968 United Kingdom .

*Primary Examiner*—Flemming Saether
*Attorney, Agent, or Firm*—Hedman, Gibson & Costigan

[57] ABSTRACT

A foam mattress pad, and process for production, having a bottom surface, a convoluted top surface and apertures extending through the pad randomly placed in relation to the convoluted pattern of the top surface. The convoluted top surface of the pad comprises a repeating pattern of peaks and troughs wherein at least two peaks are in proximity to each other without a valley therebetween adjacent the same number of proximate valleys without a peak therebetween. The distance between proximate peaks is the same as the distance between proximate valleys. The mass of the proximate peaks combine to create an additive effect in supporting the user's body and the proximate valleys allow for increased air flow between the supporting proximate peaks.

2 Claims, 6 Drawing Sheets

CONVOLUTED MATTRESS PAD HAVING MULTIPLE PROXIMATE PEAKS

FIELD OF THE INVENTION

The present invention relates to mattress pads which are generally placed over a mattress to provide additional comfort between the mattress and the user's body.

BACKGROUND OF THE INVENTION

Mattress pads have found wide favor in the bedding industry, and especially in the medical bedding area, by enhancing user comfort and reducing fatigue and bedsores. These mattress pads are generally made of a foamed polyurethane pad having a convolution pattern comprising a regular pattern of evenly spaced peaks and valleys on at least the side facing the user's body.

The advantages of such mattress pads are generally attributable to the increased air circulation between the mattress pad and the user's body. This air circulation is provided whereupon the user's weight compresses the peaks but the valleys are not so compressed and therefore allow for a degree of air flow.

The first such convoluted mattress pads had a regular peak and valley configuration on the top side with an opposed bottom side which was flat, or planar. These pads were formed by cutting a thick polyurethane foam sheet, having two flat sides, in half along a convoluted pattern resulting in two pads each having a convoluted top surface and a planar bottom surface. The peaks from the face of the bottom half cut into a convoluted pattern corresponded to the valleys of the face of the top half.

This design was later supplemented through the use of plugs punched in the valleys and removal of some of the plugs, as described in U.S. Pat. No. 4,686,724 to Bedford, or pin-pinching holes through the pad in the valleys as described in U.S. Pat. No. 4,603,445 to Spann. The removal of some of the plugs left air channels which would increase air flow and also allow fluid run-off.

However, plugs or holes placed only in the valleys of a convoluted pad are difficult to properly position and predetermined removal of only some of the plugs, as suggested in U.S. Pat. No. 4,686,724, is time consuming and burdensome.

Another aspect which has been considered for use with mattress pads is additional support in the peaks to reduce compression in the valleys and thereby improve air circulation. In U.S. Pat. No. 4,686,724 support for providing additional circulation beneath a user is dealt with by providing hills having flat-tops, and channels or holes only in the valleys between the flat-tops, of at least 1 inch in diameter.

In U.S. Pat. No. 4,866,800, also to Bedford, the hills have flat-tops of a specific diameter for support but further include holes or air channels spaced in the valleys and in the peaks, only going through from one side of the pad to the other in the valleys but specifically not in all of the peaks.

In U.S. Pat. No. 4,825,488, Bedford adds electric fans disposed through the pad, having flat-tops on the peaks but no holes or air channels, for improved air flow.

Another foam mattress pad is shown in U.S. Pat. No. 5,022,111 to Fenner, Sr. which has multiple layers, the top and bottom layers having increased density and depressions therein to minimize surface contact with the user's body.

However, each of the above items and methods of manufacture cause wasted materials and require precise or burdensome steps to manufacture.

It is therefore an object of the present invention to provide a mattress pad which enhances air flow between the mattress and the user's body while providing additional support to the user.

It is also an object to provide such a mattress pad which can be easily manufactured with minimum waste.

In a separate embodiment, it is an object of the invention to provide a mattress pad in conformance with the above objects having varying support sections along its length.

SUMMARY OF THE INVENTION

These and other objects are achieved by the present invention which provides a mattress pad comprising a foam layer having a bottom surface, a convoluted top surface and apertures randomly placed in relation to the convoluted pattern of the top surface, said apertures extending through the foam layer from the top surface to the bottom surface, wherein the convoluted top surface comprises a repeating pattern of peaks and valleys having at least two peaks in proximity to each other without a valley therebetween adjacent the same number of valleys in proximity without a peak therebetween, the distance between proximate peaks being the same as the distance between proximate valleys, such that the mass of the proximate peaks combine to create an additive effect to support the user's body and the proximate valleys allow for increased air flow between the supporting proximate peaks.

The distance between the proximate peaks are approximately the same distance as between a peak and its adjacent valley, proximate peaks preferably being from about ½ inch to about 1½ inches apart.

Any number of peaks can be in proximity, with preferably 2 to 4 peaks being proximate, the adjacent area having an equal number of proximate valleys.

The positioning of the proximate peaks can be in any shape but preferably are in a straight line (when 2–4 or more proximate peaks). Also, a triangle can be the shape when three proximate peaks are desired and a square when four proximate peaks are contemplated. As defined above, proximate valleys are in equal number and shape to the proximate peaks so that a foam layer having top and bottom planar surfaces can be cut in the middle between said top and bottom surfaces and separated to create two mirror image mattress pads which are for all intents and purposes identical.

The present invention also provides a process for producing two mattress pads each comprising a foam layer having flat bottom surface, a convoluted top surface and apertures randomly placed on the convoluted pattern of the top surface extending through the mattress pad from the top surface to the bottom surface, the convoluted top surface having a repeating pattern of peaks and valleys wherein at least two peaks are in proximity, without a valley therebetween, adjacent an area comprising the same number of proximate valleys, without a peak therebetween, the distance between the proximate peaks being the same as the distance between proximate valleys, comprising pin-punching a foam sheet having a flat top surface and a flat bottom surface to create apertures extending from the flat top surface to the flat bottom surface, cutting the foam sheet approximately midway between the flat top surface and the flat bottom surface in a convoluted pattern to create two separable convoluted faces across the foam sheet between the flat top and bottom surfaces and separating the faces.

BRIEF DESCRIPTION OF THE DRAWINGS

The appended drawings, in which like reference characters represent like parts, are intended to illustrate embodiments of the present invention without limiting the invention in any manner whatsoever.

DESCRIPTION OF THE PREFERRED EMBODIMENT

Figure 1:
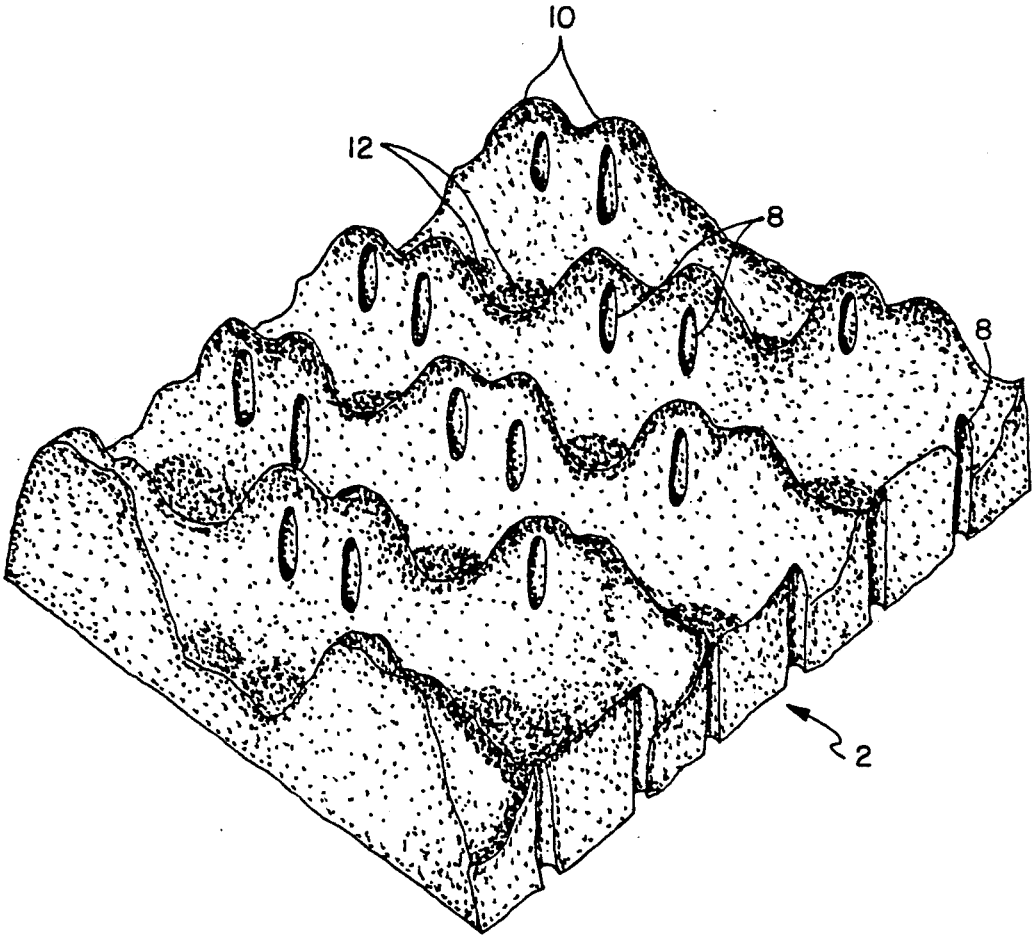
FIG. 1 is a perspective view of a section of a mattress pad of the present invention.

The present invention, as best seen in FIGS. 1, 2, 3 and 6, comprises a polyurethane foam pad 2 having a convoluted top face 4 and a planar bottom face 6 with apertures 8 extending from the top face 4 through to the bottom face 6 located randomly across the convolution pattern.

Preferably, the foam for use in the present invention is a polyurethane foam having a density of from about 1.0 to about 2.2 lb/cu.ft., and preferably 1.5 lb/cu.ft., having a deflection of from about 20 to about 40 and preferably between 30 and 35 ILD. The convolution pattern is preferably in the range of 1 inch to 4 inches peak height with a ½ inch to 1 inch base, a peak height of 2 inches with a ½ inch base being most preferred.

The convoluted top face 4 comprises a regularly repeating pattern of peaks 10 and valleys 12 where a group of 2 or more peaks 10 are in proximity with each other, adjacent to a group of the same number of proximate valleys 12. The distance between the proximate peaks 10 is the same as the distance between proximate valleys 12, as is the distance between an adjacent peak 10 and valley 12 at adjacent ends of a proximate group of each. As such, either a peak 10 or valley 12 occurs at regular intervals across the top face 4 of the pad 2, with at least two peaks 10 being proximate, without a valley 12 therebetween, followed by an equal number of valleys 12 without a peak 10 therebetween. In practice, it has been found that occurrence of a peak 10 or valley 12 every 1–3 inches, and preferably every 1½ inches, when using a pad ½ inch thick at the valleys 12 and 2 inches thick at the peaks 10.

Figure 5:
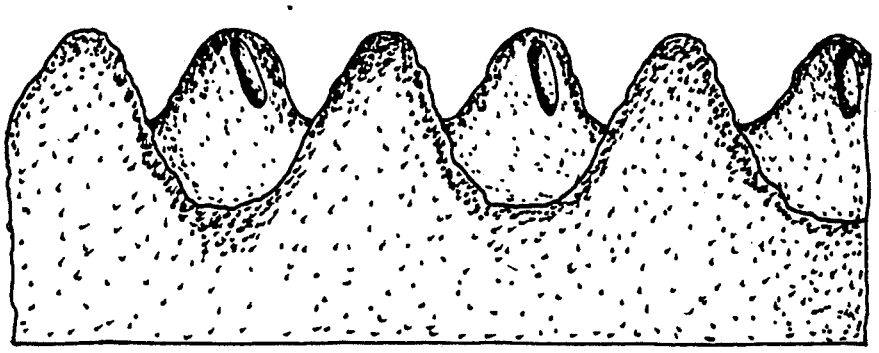
FIG. 5 (PRIOR ART)
FIG. 5 is an elevational section of the pad of FIG. 4.
Figure 2:
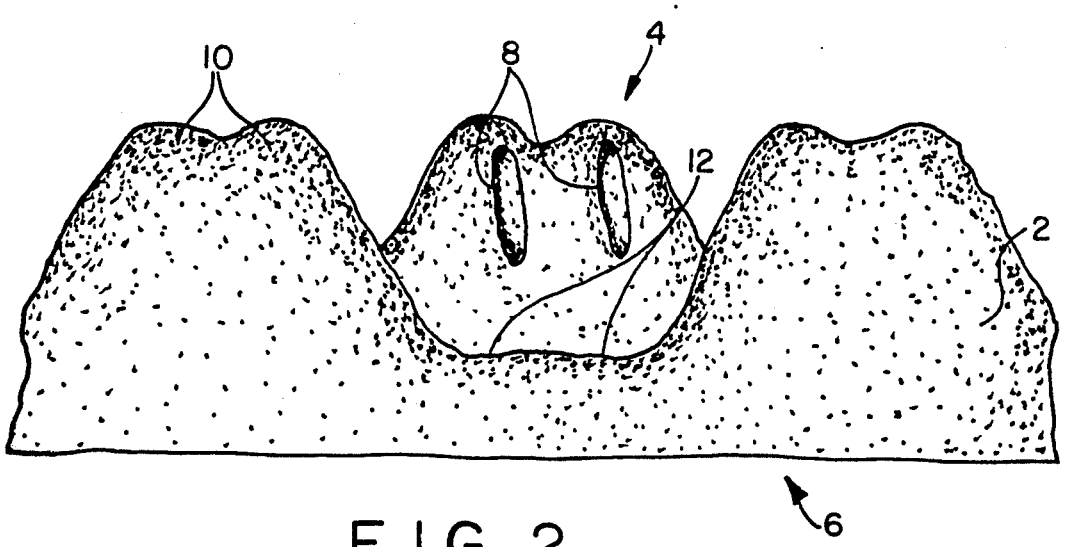
FIG. 2 is an elevational cross section of the pad of FIG. 1.
Figure 3:
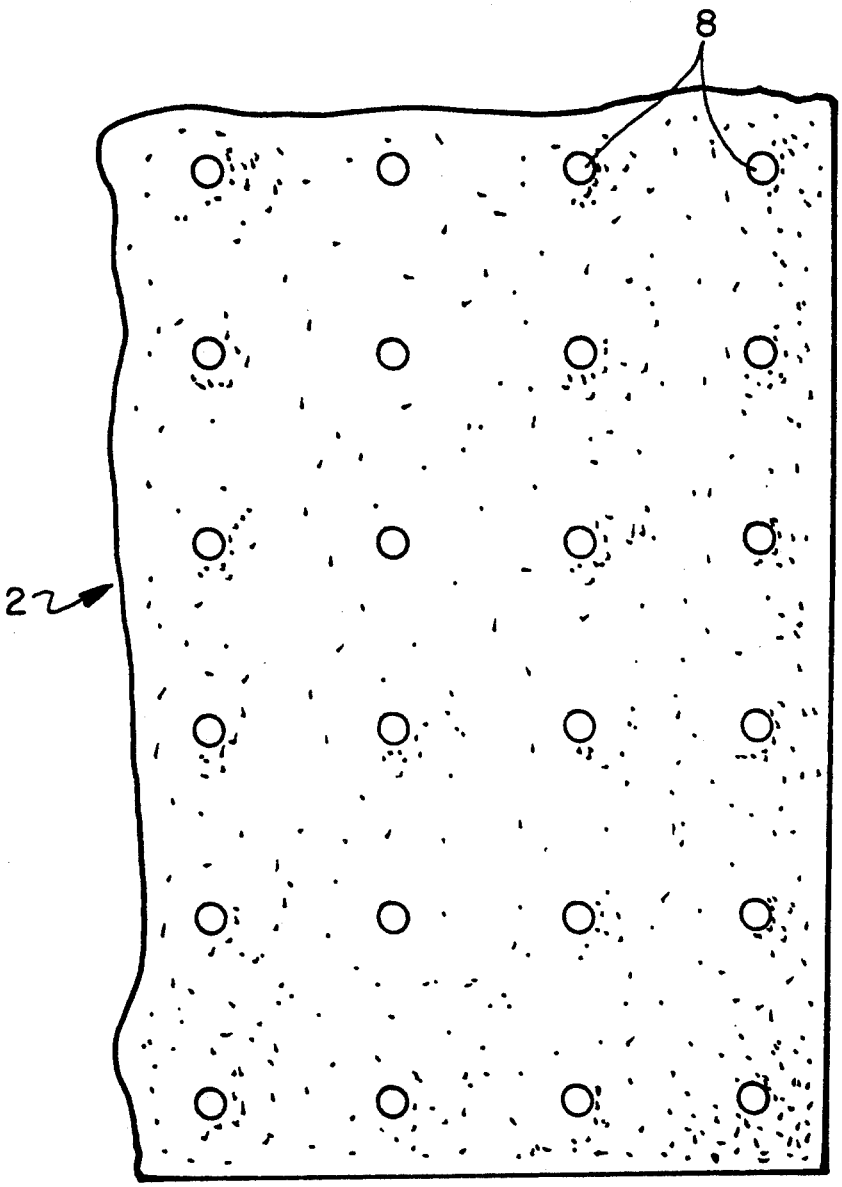
FIG. 3 is a top plan view of the mattress pad of FIG. 1.
Figure 4:
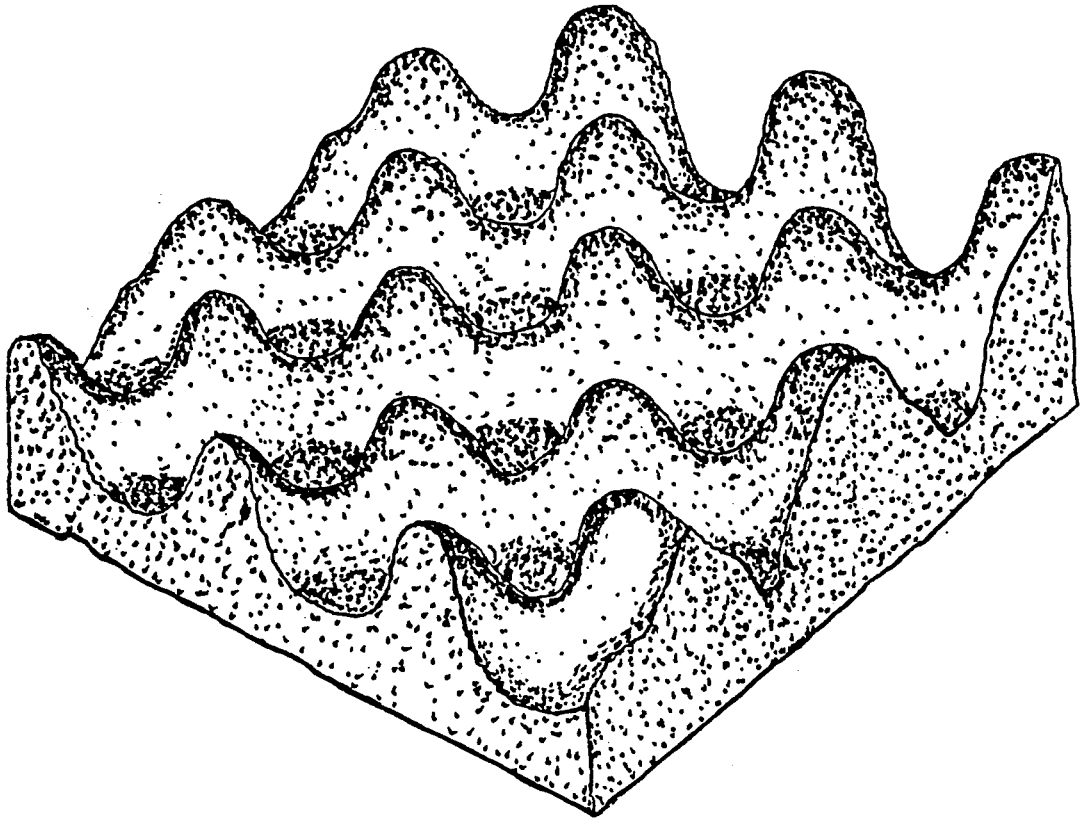
FIG. 4 (PRIOR ART)
FIG. 4 is a perspective view of a section of the prior art mattress pad.

The mattress pad of the prior art, shown in FIGS. 4 and 5, consists of a regularly repeating pattern of peaks 10 and valleys 12 in a checkerboard pattern. With the mattress pad 2 of the present invention, however, the mass of two or more proximate peaks 10 are combined to provide greater support to the user by reducing the compression thereof. The reduced compression of the peaks 10 results in greater maintenance of air flow channels in the valleys 12. Additionally, the use of two or more proximate valleys 12 improves the air flow by creating larger air flow channels when a user is on the pad 2.

Air movement is also enhanced by the use of apertures 8 extending through the mattress pad 2, as set forth above. Random placement of the apertures across the convoluted top face 8 of the pad 2 has been found to adequately provide the desired air flow to the user's body. The apertures 8 are preferably from about ¾ inch to about 2 inches apart on center and are preferably from about ⅛ inch to about ½ inch in diameter, with apertures 8 of about ¼ inch diameter every 1½ inches on center being most preferred.

Manufacture of the present mattress pad 2 providing improved support and air flow is improved through simplification of the process. A foam sheet having two planar surfaces of a thickness equal to or slightly larger than the sum of the peak height and the valley height is passed through a pin-punching machine. The pin-punching machine creates apertures 8 by removing the foam therefrom, leaving a hole from one planar surface of the foam sheet to the other. The perforated foam sheet is then passed through a convolution cutting machine to cut the convolution pattern, leaving two mirror image top faces 8, the peaks 10 of one face 8 being mated with the valleys 12 of the opposed face 8. The two mattress pads 2 are then separated.

The convolution cutting machine is set to provide the proximate peaks 10 and valleys 12. As the foam sheet is passed through the convolution cutting machine, the placement of the apertures 8 across the foam sheet need not be considered with respect to the convolution pattern, thereby allowing for punching prior to cutting the convolution pattern, and limiting the need for precise placement and close worker supervision of the process.

Figure 6:
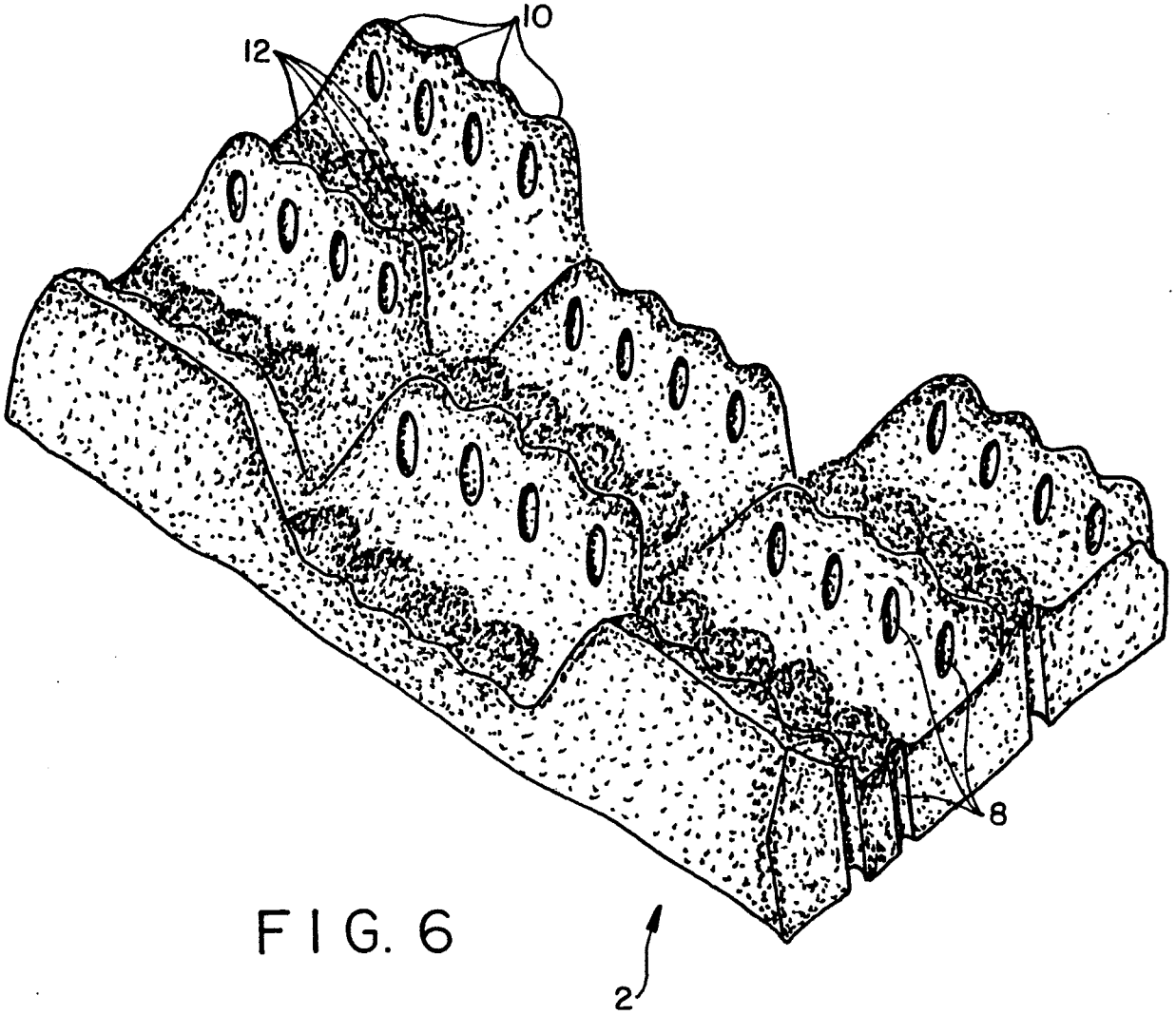
FIG. 6 is a perspective view of another embodiment of the preferred mattress pad of the present invention.

The mattress pads 2 of the present invention can be any arrangement of regular patterns of proximate peaks 10 and valleys 12. For instance, the entire top face 8 of the mattress pad 2 can be a single arrangement of two proximate peaks 10 adjacent to two proximate valleys 12, a portion of which is shown in FIG. 1. Similarly, the entire pad 2 can be a single arrangement of four peaks 10 adjacent four valleys 12, as shown in FIG. 6. However, the arrangement of proximate peaks 10 and valleys 12 can also be only on a portion of the top face 8 of the pad 2, i.e. to provide additional support to certain areas which correspond to heavier parts of the user's body.

Figure 7:
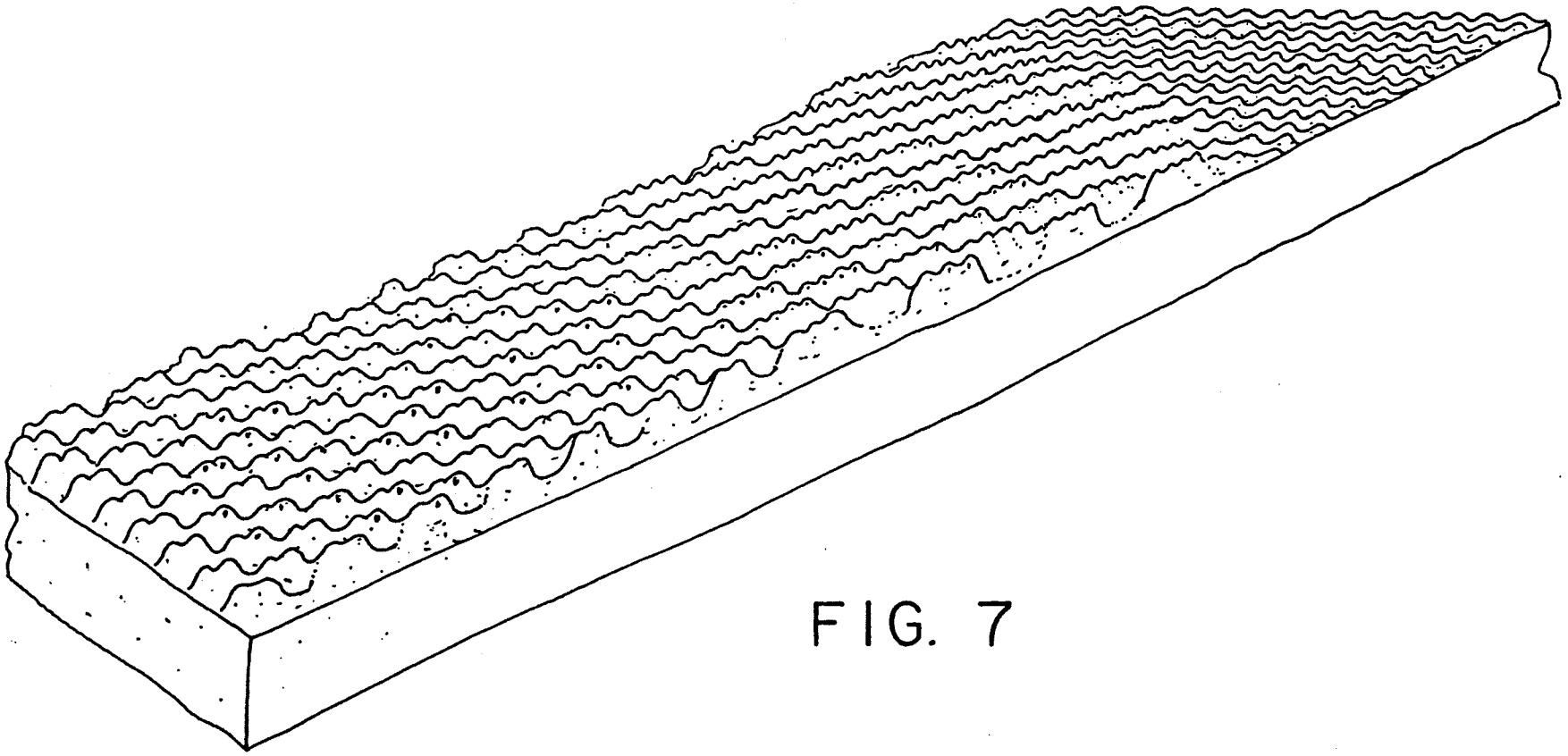
FIG. 7 is a perspective view of a mattress pad of the present invention having various support zones along its length.

For example, as shown in FIG. 7, the head area 14 (i.e. about 1/5 inch of the top pad 2) has a single peak 10 adjacent a single valley 12, the foot area 18 (i.e. about the bottom 2/5 of the mattress pad 2) has two proximate peaks 10 adjacent two proximate valleys 12 while the mid area 16 (i.e. about the middle 2/5) has four proximate peaks 10 adjacent four proximate valleys 12. Other arrangements, including use of single peaks 10 adjacent single valleys 12 in one or more areas with 2 or more proximate peaks 10 adjacent an equal number of proximate valleys 12 in another area is contemplated under the present invention.

Modifications and variations of the present invention will be obvious to one skilled in the art based on the present disclosure. All such modifications and variations are intended to be covered by the present invention, to be limited only be the appended claims. All patents and publications cited are hereby incorporated by reference.

I claim:

1. A mattress pad comprising a foam layer having a bottom surface, a convoluted top surface and apertures randomly placed in relation to the convoluted pattern of the top surface, said apertures extending through the foam layer from the top surface to the bottom surface, wherein the convoluted top surface comprises a repeating pattern of peaks and valleys having at least two peaks in proximity to each other without a valley therebetween adjacent the same number of valleys in proximity without a peak therebetween, the distance between proximate peaks being the same as the distance between proximate valleys, such that the mass of the proximate peaks combine to create an additive effect to support the user's body and the proximate valleys allow for increased air flow between the supporting proximate peaks, further comprising three zones, one at approximately the top 1/5 of the length of the top surface and one approximately the next 2/5 of the length in the middle of the top surface, and one at approximately the bottom 2/5 of the top surface wherein the top and bottom zones comprise two proximate peaks adjacent two proximate valleys and the middle zone comprises four proximate peaks adjacent four proximate valleys.

2. A mattress pad comprising a foam layer having a bottom surface, a convoluted top surface and apertures randomly placed in relation to the convoluted pattern of the top surface, said apertures extending through the foam layer from the top surface to the bottom surface, wherein a portion of the convoluted top surface comprises a repeating pattern of peaks and valleys having at least two peaks in proximity to each other without a valley therebetween adjacent the same number of valleys in proximity without a peak therebetween, the distance between proximate peaks being the same as the distance between proximate valleys, such that the mass of the proximate peaks combine to create an additive effect to support the user's body and the proximate valleys allow for increased air flow between the supporting proximate peaks, further comprising three zones, one at approximately the top 1/5 of the length of the top surface and one approximately the next 2/5 of the length in the middle of the top surface, and one at approximately the bottom 2/5 of the top surface wherein the top zone comprises one proximate peak adjacent one proximate valley, the middle zone comprises four proximate peaks adjacent four proximate valleys and the bottom zone comprises two proximate peaks adjacent two proximate valleys.

* * * * *